US008203413B2

(12) United States Patent
Hironaka et al.

(10) Patent No.: US 8,203,413 B2
(45) Date of Patent: Jun. 19, 2012

(54) WINDING COMPONENT

(75) Inventors: Kiyoshi Hironaka, Shizuoka (JP); Hideyuki Akiyama, Yamaguchi (JP); Toru Hirohashi, Shizuoka (JP); Katsuo Yamada, Shizuoka (JP); Akihiro Fujii, Shizuoka (JP)

(73) Assignee: FDK Corporation, Tokyo (JP)

( * ) Notice: Subject to any disclaimer, the term of this patent is extended or adjusted under 35 U.S.C. 154(b) by 66 days.

(21) Appl. No.: 12/223,430

(22) PCT Filed: Jan. 24, 2007

(86) PCT No.: PCT/JP2007/051066

§ 371 (c)(1),
(2), (4) Date: Nov. 10, 2008

(87) PCT Pub. No.: WO2007/086412

PCT Pub. Date: Aug. 2, 2007

(65) Prior Publication Data

US 2009/0302988 A1 Dec. 10, 2009

(30) Foreign Application Priority Data

Jan. 30, 2006 (JP) ..... 2006-020387

(51) Int. Cl.

| | |
|---|---|
| ***H01F 27/29*** | (2006.01) |
| ***H01F 27/02*** | (2006.01) |
| ***H01F 27/28*** | (2006.01) |
| ***H01F 27/30*** | (2006.01) |

(52) U.S. Cl. ..... 336/192; 336/90; 336/195; 336/196; 336/198

(58) Field of Classification Search ..... 336/90, 336/195, 196, 198, 192

See application file for complete search history.

(56) References Cited

U.S. PATENT DOCUMENTS

| | | | | |
|---|---|---|---|---|
| 4,095,206 | A * | 6/1978 | Hishiki | 336/96 |
| 5,008,644 | A * | 4/1991 | Cooper | 336/192 |
| 5,412,367 | A * | 5/1995 | Shibui et al. | 336/192 |
| 6,967,558 | B2 * | 11/2005 | Fushimi | 336/208 |
| 2004/0183642 | A1 * | 9/2004 | Suzui | 336/192 |

FOREIGN PATENT DOCUMENTS

| | | | |
|---|---|---|---|
| JP | 62-19721 | | 2/1987 |
| JP | 62-49218 | | 3/1987 |
| JP | 62-60019 | | 4/1987 |
| JP | 02256212 | A * | 10/1990 |
| JP | 4-76018 | | 7/1992 |
| JP | 11-176658 | | 7/1999 |
| JP | 2001-345222 | | 12/2001 |

* cited by examiner

*Primary Examiner* — Elvin G Enad
*Assistant Examiner* — Tsz Chan
(74) *Attorney, Agent, or Firm* — Harness, Dickey & Pierce, PLC

(57) ABSTRACT

[Problems] To realize a structure that is substantially highly reliable, that solves a problem of a wire break accompanied by an application of an external force to a terminal and at the same time solves a problem of a wire break caused by heat effects during dip soldering, without causing a strength reduction of the terminal, cost increase, and wire thinning.
[Means for Solution] A winding component in which a terminal 12 is disposed in a protruding manner to a bobbin 14 provided with a winding portion, and a winding end is connected to the terminal, wherein a resin protrusion 40 is formed integral with the bobbin at a foot of the terminal, the resin protrusion is shaped with a part of its circumference notched so that a side surface of the terminal partially juts out, and a wire material that is wound around the resin protrusion a plurality of times comes into contact with the terminal and is to be connected by dip soldering.

3 Claims, 3 Drawing Sheets

WINDING COMPONENT

TECHNICAL FIELD

The present invention relates to a terminal mounting structure and a connecting structure for connection between a terminal and a winding end, in a winding component, and more particularly to a winding component that has a resin protrusion formed integral with a bobbin at a foot of a terminal that is connected with a winding end, the resin protrusion is shaped with a part of its circumference notched so that a side surface of the terminal partially juts out, and when the winding end is wound around the resin protrusion a plurality of times the terminal and the wire material come into contact to be connected by soldering.

BACKGROUND ART

As a backlight light source of a liquid crystal display device, a cold cathode discharge tube is generally used, which is lit and driven by an inverter transformer that generates high voltage. An inverter transformer is, for example, structured with a primary winding and a secondary winding formed at a winding portion of a bobbin, as well as with winding ends connected to a plurality of terminals disposed in a protruding manner at a terminal-fixing portion, and equipped with a core so as to form a closed magnetic circuit. Since a relatively large current flows through the primary winding, an electric wire with a wire diameter of equal to or more than 0.1 mm (referred to as a thick wire) made by stranding a plurality of polyurethane-covered wires is used. On the other hand, although a high voltage is generated in the secondary winding the amount of current that flows through the secondary winding is small, so a single polyurethane-covered wire (referred to as a thin wire) with a wire diameter of equal to or less than 0.1 mm (e.g. the wire diameter of a copper wire is about 0.03 to 0.04 mm) is used. Each winding end made from the above wire materials are bound to the terminals and soldered. Although soldering is performed by dipping (immersing) into molten solder, in general, the dipping temperature and dipping duration differ for a thick wire and a thin wire described above, and therefore dipping is performed under their respective optimal conditions.

Problems rarely occur with the thick stranded wires, but with the thin single wires, in their connections to the terminals, there are two major problems that are likely to cause failures. One of them is that when bending deformation occurs due to an external force applied to a tip portion of the terminal, deformation also occurs at a binding portion of the wire material at the foot so that the wire material locally extends, and thus leads to a risk of a broken wire. The other problem is that, since the wire material is thin, a break is apt to occur from being affected by heat stress during dip soldering.

A method for solving the problem by improving the shape of the terminal itself is proposed (refer to Patent document 1) to solve the former problem regarding a wire break associated with an external force applied to the tip portion of the terminal. This is a technique for preventing a break in the wire material by forming a constriction or making the diameter small at the foot of the terminal at a position ahead of the binding portion of the winding end (on the side opposite the bobbin), so that when an external force is applied to the proximity of the terminal tip portion, bending occurs at the constriction or the small diameter portion and deformation does not occur at the portion of the terminal for binding the winding end. However, such a terminal shape will be a factor that leads to a reduction in strength and an increase in cost will occur since processing is required for the terminal.

Regarding the latter problem on a wire break caused by heat effects during dip soldering, a method for solving the problem by devising the structure of a terminal-fixing portion is proposed (refer to Patent document 2). Such a structure has ribs formed on both sides of an upper terminal-fixing portion, a foot portion of a draw-out groove for drawing out a winding end positioned substantially in line with a top surface of the rib, the winding end that is to be drawn out to the outside from the draw-out groove is drawn out from the foot portion of the draw-out groove, further hung on the top surface of the rib, and then bound to the terminal. In this way, an attempt is made to prevent a wire break caused by the winding end sinking into the mold melted by heat effects during dip soldering.

Patent document 1: Japanese Patent Application Laid-open No. 11-176658

Patent document 2: Japanese Patent Application Laid-open No. 2001-345222

DISCLOSURE OF INVENTION

Problems to be Solved by the Invention

However, even the above-described structure cannot solve the problems of wire thinning, because the thin single wire that is drawn out is dipped into the molten solder in a single state. Moreover, since these are separate methods, use of neither of the techniques can simultaneously solve the two problems of wire break associated with the application of an external force to a terminal and a wire break caused by heat effects during dip soldering.

The problems to be solved by the present invention are those of a wire break associated with an application of an external force to a terminal and a wire break caused by heat effects during dip soldering. The present invention solves both of the problems simultaneously, and yet does not reduce the terminal strength, nor increase the cost and also avoids wire thinning, so that an essentially highly reliable structure is realized.

Objects and constitutions of the present invention other than ones stated above will be apparent from the following detailed description and drawings attached herein.

Means for Solving the Problems

Means for solving the problems of the present invention are given hereunder.

The present invention is, a winding component in which a terminal is disposed in a protruding manner to a bobbin provided with a winding portion, and a winding end is connected to the terminal, characterized in that:

a resin protrusion is formed integral with the bobbin at a foot of the terminal, the resin protrusion is shaped with a part of its circumference notched so that a side surface of the terminal partially juts out, and a wire material that is wound around the resin protrusion a plurality of times comes into contact with the terminal and is to be connected by soldering.

The wire material in subject is an insulation coated single wire with a wire diameter equal to or less than 0.1 mm, which is wound around the resin protrusion a plurality of times in a close wound state, and a part of the resin protrusion including a contact portion between the terminal and the wire material, which is at an opposite side to a lead wire portion in a single wire state, is dip soldered.

Such a winding component is, for example, an inverter transformer of a cold cathode tube for lighting, and the resin protrusion is provided at a foot of a terminal thereof for a high voltage secondary winding. Since the primary winding is a thick wire, the terminals thereof need not be provided with such resin protrusions.

Effect of the Invention

The winding component according to the present invention is structured with a resin protrusion formed integral with a bobbin around the foot of the terminal and with a notch provided so that the terminal contacts the wire material when the winding end is bound around the resin protrusion, and since the surface of the resin protrusion acts as a support point at bending, the foot of the terminal (binding portion of the winding end) does not deform by stress even if an external force is applied to the terminal, and thus the wire material does not deform (extend) and hence there is no risk of a wire break. Moreover, the winding end is wound around so as to encompass the terminal and the resin protrusion, so that even if there are heat effects during dip soldering, the heat is absorbed by the resin protrusion and thus resists wire thinning. If the winding end is wound around a plurality of times in a close wound state, problems of reduction of the section area or strength do not arise even if the wire material should thin down. Further, dip soldering can be performed to a portion of the resin protrusion including the contact portion between a terminal and a wire material, at the side opposite the lead-out wire portion that is in a single wire state. In this way, wire thinning does not occur at the lead-out wire portion that is in a single wire state and there is no risk of a wire break. From the above characteristics, a highly reliable winding component can be obtained.

Features/advantages other than ones stated above will be apparent from the following detailed description and drawings attached herein.

EXPLANATION OF REFERENCE CHARACTERS

10 magnetic core
12 pin terminal
14 bobbin
40 resin protrusion

BEST MODE FOR CARRYING OUT THE INVENTION

Figure 1:
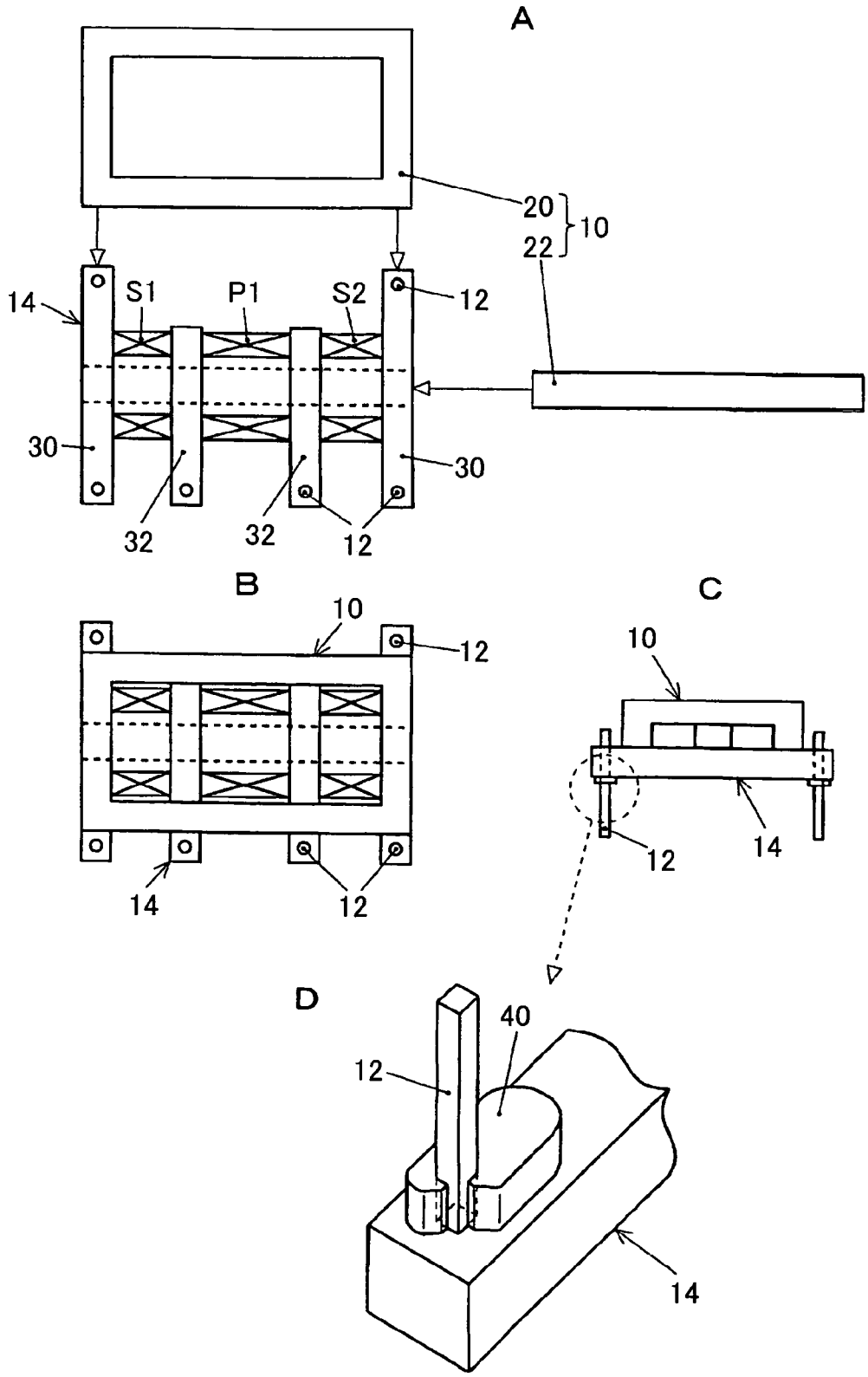
FIG. 1 is a schematic explanatory view showing an embodiment of a winding component according to the present invention.

FIG. 1 is an explanatory view schematically showing an embodiment of a winding component according to the present invention, which shows an example of an inverter transformer preferable for a discharge tube for lighting. Here, A shows a disassembled state and B shows an assembled state, each of them in a planar view. Further, C shows a side view and D shows the terminal in a fixed state, which is a main section of the present embodiment.

This inverter transformer is an example of the most simple two-output type comprising a pair of magnetic cores 10 which in combination form a closed magnetic circuit, a bobbin 14 for winding provided with a plurality of pin terminals 12, and a primary winding P1 and two secondary windings S1, S2, which are wound around the bobbin 14.

The magnetic core 10 is comprised of a frame shaped core 20 and a stick shaped core 22 that are made of ferrite and the like, that are assembled into a form of two identical rectangles aligned side by side to form a closed magnetic circuit. The stick shaped core 22 has a rectangular cross section. The frame shaped core 20 has a rectangular frame shaped portion where both side portions thereof protrude a length equal to the height of the stick shaped core 22, with a length that is equal to that of the stick shaped core 22, and a width of the opening of the frame that is wider than that of the stick shaped core 22. Therefore when the frame shaped core 20 is covered over the stick shaped core 22, both ends at a top surface of the stick shaped core 22 contact both ends at a bottom surface of the frame shaped core 20, to form a shape of two identical rectangles aligned side by side.

The bobbin 14 for winding is structured with divider plates 32 placed to jut out at two locations of the cylindrical winding portion that has flanges 30 at both ends, and the end portions of the flanges 30 and the divider plates 32 serve as terminal-fixing portions with a plurality of pin terminals 12 mounted thereon. The winding portion is a square cylindrical shape that allows the stick shaped core 22 to fit exactly therein, and the distance between the bobbins at both ends is made to correspond to the length of the frame shaped core 20. The plurality of pin terminals 12 have their base portions planted on the terminal-fixing portions and the tip portions thereof are structured so that insertion into a mounting board for connection thereto is enabled.

The primary winding P1 is wound around at the center portion of the winding portion and the two secondary windings S1, S2 are wound around at both side sections of the winding portion. For example, an electrical wire (stranded wire) covered with polyurethane with a diameter of 0.35 mm is used as the primary winding and an electrical wire (single wire) covered with polyurethane with a diameter of 0.03 mm is used as the secondary winding. The winding ends are wound around the pin terminals 12 and connected by soldering.

The characteristic of the winding component according to the present embodiment is, in particular, the connection structure of the winding end at the foot of the pin terminals 12. As shown in D of FIG. 1 (D shows the state of the bobbin seen from the backside (the side of an opposing face of the mounting board)), a resin protrusion 40 is formed integral with the bobbin 14 at the foot of the pin terminal 12, and the resin protrusion 40 is shaped with a part of its surrounding notched to let a part of the terminal side face jut out. That is, the resin protrusion 40 and the bobbin 14 are molded integrally. The notch is shaped to allow the terminal and the wire material to contact each other when the winding end is wound around the resin protrusion. Note that such a resin protrusion can be formed at the foot of the terminal that connects the thin electrical wires. Here, a resin protrusion is formed only to the secondary side terminal to which an electrical wire (single wire) covered with polyurethane with a diameter of 0.03 mm is bound.

The resin protrusion 40 is substantially oval with a pin terminal 12 situated toward one end (the end farther away from the winding portion) thereof. Here, a pin terminal with a rectangular section is shown. A single ridge line of the rectangular pin terminal 12 and its proximal area is made to be exposed. The height of the resin protrusion 40 is preferably at least about 1 mm and its length is preferably about 3 mm. The side surface area of the pin terminal that is exposed from the notch is preferably about 20-30% of the entire circumference. In this example, approximately three quarters of the periphery of the pin terminal 12 is surrounded by the resin protrusion 40.

Figure 2:
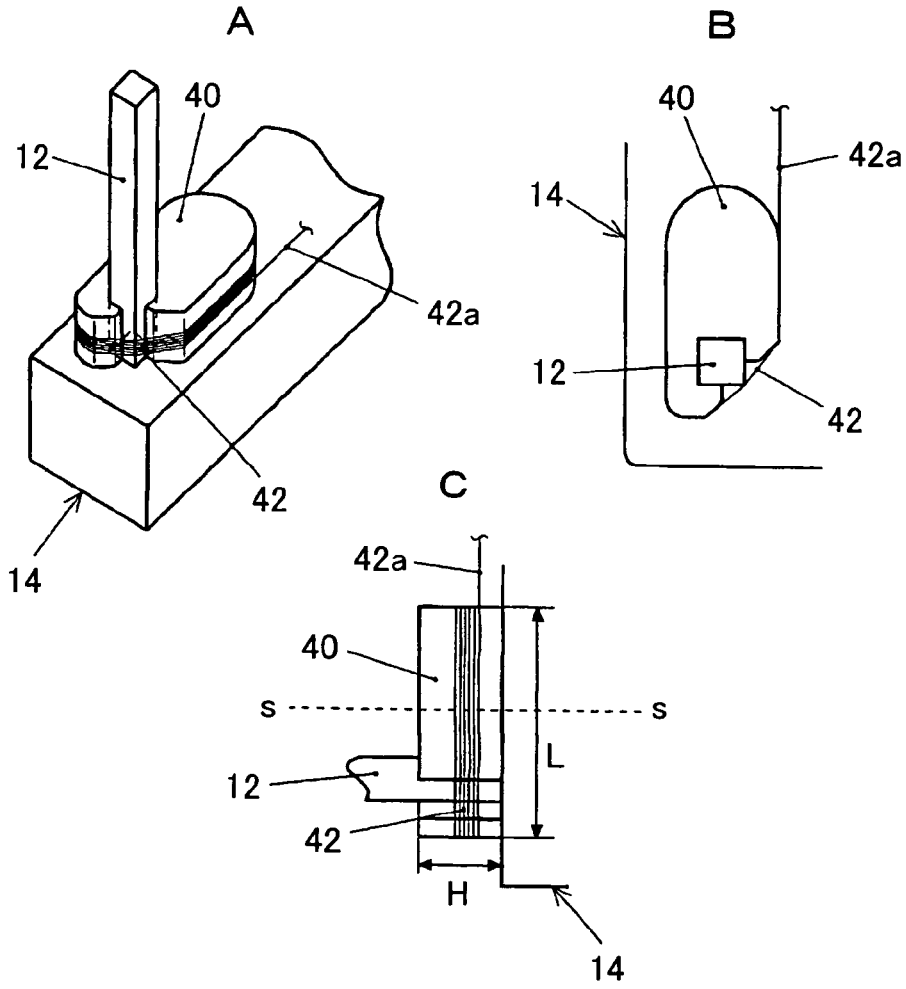
FIG. 2 is an explanatory view showing a winding end in a wound state.

FIG. 2 shows the winding end in a bound condition. The winding end is wound around the resin protrusion 40 a plurality of times (e.g. approximately ten times) in a close wound state and the pin terminal 12 comes into contact with the wire material 42. The lead wire portion 42*a* that is in a single wire state is positioned on the opposite side of the contact portion between the pin terminal 12 and the wire material 42. That is, the winding end is drawn out in a single wire state from the opposite side of the portion where a notch is formed in the resin protrusion 40, and wound around the side face of the resin protrusion 40 a plurality of times in a close wound state. As shown in C of FIG. 2, a portion of the resin protrusion 40 that includes the contact portion between the pin terminal 12 and the wire material 42, at the side opposite the lead wire portion in a single wire state, is dip soldered. The surface level of the molten solder during dipping is shown with a reference character s-s.

When the height H of the resin protrusion 40 is about 1 mm, winding approximately ten times can be performed easily. Further, as shown in C of FIG. 2, a liquid level s-s of the molten solder during dipping needs to be controlled to approximately half the length of the resin protrusion 40. However, as mentioned above, when the length L of the resin protrusion 40 is about 3 mm, the liquid level of the molten solder can be controlled easily, and there is no risk that the lead wire portion 42*a* in a single wire state contacts the solder. Thus, wire thinning does not occur to the lead wire portion 42*a* in a single wire state, and the possibility of a wire break is removed. Moreover, since the winding end is wound a plurality of times in a close state so as to surround the pin terminal 12 and the resin protrusion 40, even if there are heat effects during dip soldering, heat is absorbed by the resin protrusion and the wire material is less likely to thin down. Therefore, even if it does thin down, problems of decrease in the sectional area or problems relating to strength do not arise.

Figure 3:
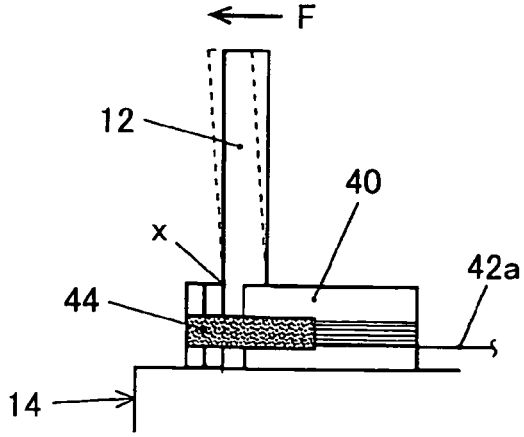
FIG. 3 is an explanatory view showing deformation caused when external force is applied to the tip portion of the terminal.

FIG. 3 is an explanatory view showing deformation of the pin terminal when an external force is applied to the tip portion thereof. Reference number 44 shows the soldered portion. Because the resin protrusion 40 is formed integral with the bobbin 14 around the foot of the pin terminal 12, even when an external force F is applied to the tip portion of the pin terminal 12, the part of the surface portion of the resin protrusion 40 that surrounds the pin terminal 12 becomes a support point (the support point is shown by a reference character x) at bending, and the pin terminal 12 simply deforms as shown by the dotted line so that the foot of the pin terminal 12 (a binding portion of the winding end) does not deform by the external force. Therefore the wire material does not deform (extend) and there is no possibility of a wire break.

If the pin terminal 12 has a rectangular section, when an external force is applied thereto, bending in the diagonal direction is difficult but easy in the direction parallel or perpendicular to the section. However, as to the pin terminal 12, because none of the four faces are free and are supported by the resin protrusion 40, such portions serve as the support points at bending, and thus the foot (binding portion of the winding end) of pin terminal 12 does not deform with an external force from any of forward, backward, right, and left direction. With respect to a sample terminal, an external force of 5 N was applied to the tip portion of the pin terminal in the forward, backward, right, and left directions, but a break in the secondary winding did not occur.

Figure 4:
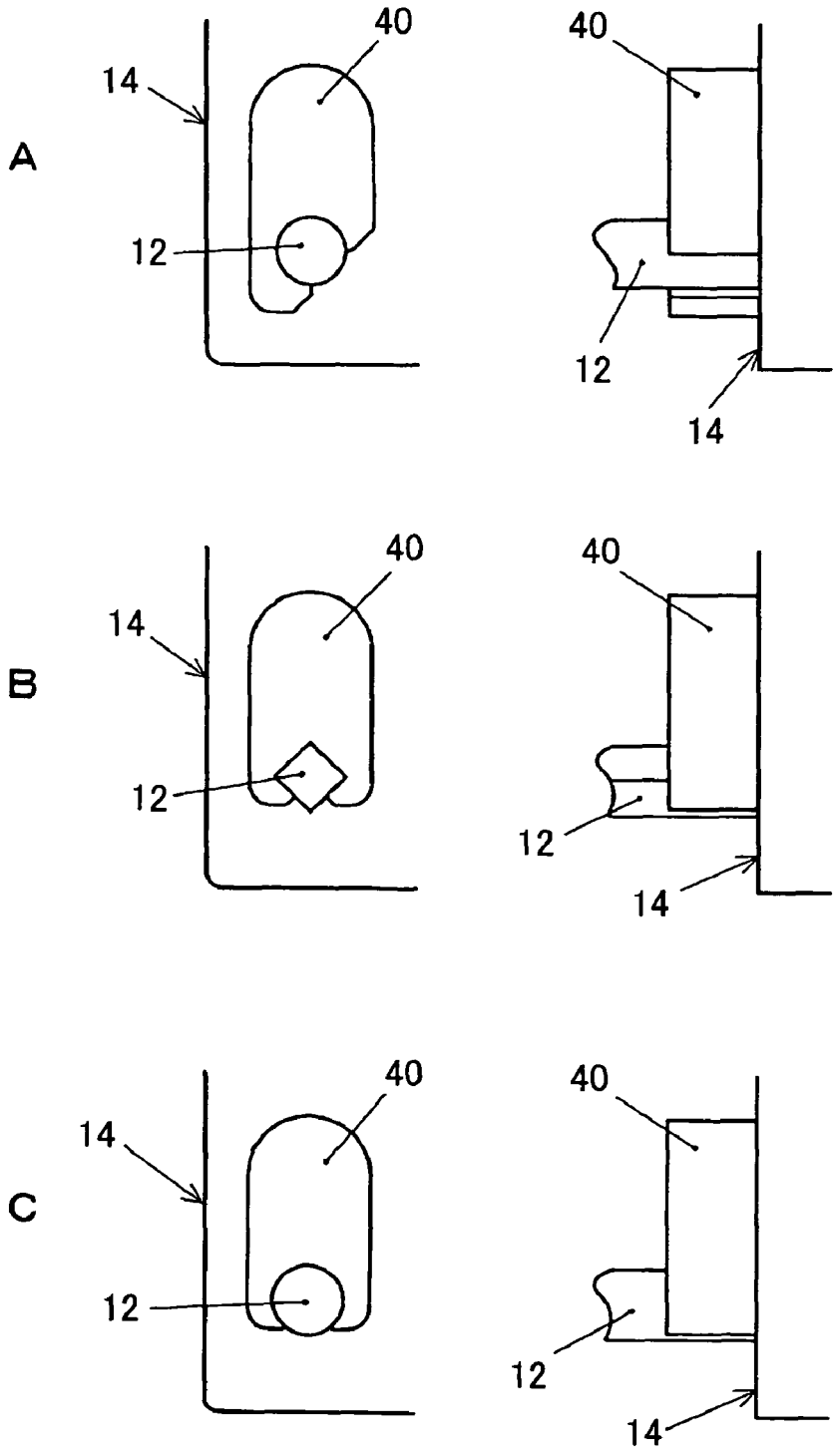
FIG. 4 is an explanatory view of the main parts showing other embodiments according to the present invention.

Other embodiments according to the present invention are shown in FIG. 4. Since the basic composition is the same with the embodiment described above, corresponding parts are numbered with the same reference numbers for a simplified description. A is an example that utilizes a pin terminal 12 with a circular section. B is an example that utilizes a pin terminal 12 with a rectangular section where one of its ridge lines is positioned to conform to one end of the resin protrusion 40 letting the resin protrusion 40 have a symmetrical shape. C is a pin terminal 12 of B with a circular section. As with these examples, the shape of the terminal and the resin protrusion can be altered arbitrarily.

Further, needless to say, the winding component according to the present embodiment is applicable to not only straight-shape pin terminals but to curved-shape pin terminals, terminal constructions that allow surface mounting, and the like.

As stated above, although the present invention has been explained based on its representative embodiments, various embodiments other than those stated above can be also achieved in the present invention.

Industrial Applicability

The winding components according to the present embodiments are configured to have the resin protrusion formed integral with the bobbin around the foot of the terminal, and the resin protrusion is provided with a notch that allows the terminal to contact the wire material when the winding end is wound. Therefore, even if an external force is applied to the terminal, since the surface of the resin protrusion becomes the support point at bending, the foot (the binding portion of the winding end) of the terminal does not deform under stress, and thus the wire material does not deform (extend) so that there is no risk of a wire break at all. Moreover, the winding end is wound around to surround the terminal and the resin protrusion so that even if there are heat effects during dip soldering, the heat is absorbed by the resin protrusion and the wire material is less likely to thin down. And even if the wire material does thin down, neither problems of decrease in the section area nor strength problems arise on condition that the winding end is wound a plurality of times in a close wound state. Additionally, dip soldering can be performed to a part of the resin protrusion including the contact portion between the terminal and the wire material that are on the opposite side of the lead wire portion in a single wire state. Therefore the wire of the lead wire portion in a single wire state does not thin down and the risk of a wire break is eliminated. Hereby, a highly reliable winding component can be achieved.

The invention claimed is:

1. A winding component in which a terminal is disposed in a protruding manner to a bobbin provided with a winding portion, and a winding end is connected to the terminal, characterized in that:

a resin protrusion is formed integral with the bobbin at a foot of the terminal, the resin protrusion being oval;

the resin protrusion is shaped with a part of its circumference notched so that only a part of a side surface of the terminal juts out;

the winding end has a wound-around portion that is wound around the resin protrusion a plurality of times and a non-wound-around portion that is not wound around the resin protrusion, the non-wound-around portion being drawn out in a single wire state from the wound-around portion, the wound-around portion comes into contact with the terminal at a portion where a notch is formed in the resin protrusion and is to be connected by soldering;

the portion where the notch is formed is provided at an end portion in a major axis direction of the oval resin protrusion; and the non-wound-around portion of the winding end is positioned on an opposite side of the portion where the notch is formed in the resin protrusion in the major axis direction.

2. A winding component according to claim 1, wherein the wire material is an insulation coated single wire with a wire diameter equal to or less than 0.1 mm, which is wound around the resin protrusion a plurality of times in a close wound state, and a part of the resin protrusion including a contact portion between the terminal and the wire material, which is at an opposite side to a lead wire portion in a single wire state, is dip soldered.

3. A winding component according to claim 1 or 2, wherein the winding component is an inverter transformer of a cold cathode tube for lighting, and the resin protrusion is provided at a foot of a terminal thereof for a high voltage secondary winding.

* * * * *